US009810091B2

(12) United States Patent
Zacchera et al.

(10) Patent No.: US 9,810,091 B2
(45) Date of Patent: Nov. 7, 2017

(54) SMART ACTIVE CLEARANCE CONTROL BETWEEN A ROTOR BLADE AND A SHROUD

(71) Applicant: United Technologies Corporation, Hartford, CT (US)

(72) Inventors: Kevin Zacchera, Glastonbury, CT (US); Patrick D. Couture, Tolland, CT (US)

(73) Assignee: United Technologies Corporation, Farmington, CT (US)

( * ) Notice: Subject to any disclaimer, the term of this patent is extended or adjusted under 35 U.S.C. 154(b) by 300 days.

(21) Appl. No.: 14/823,568

(22) Filed: Aug. 11, 2015

(65) Prior Publication Data

US 2016/0047269 A1 Feb. 18, 2016

Related U.S. Application Data

(60) Provisional application No. 62/036,452, filed on Aug. 12, 2014.

(51) Int. Cl.

| | |
|---|---|
| ***F01D 11/24*** | (2006.01) |
| ***F01D 21/00*** | (2006.01) |
| ***F01D 5/22*** | (2006.01) |
| ***F01D 11/20*** | (2006.01) |

(52) U.S. Cl.

CPC ..... *F01D 21/003* (2013.01); *F01D 5/225* (2013.01); *F01D 11/20* (2013.01); *F05D 2220/30* (2013.01); *F05D 2240/11* (2013.01); *F05D 2260/81* (2013.01); *F05D 2260/83* (2013.01); *F05D 2270/20* (2013.01); *F05D 2270/44* (2013.01); *F05D 2270/71* (2013.01)

(58) Field of Classification Search

CPC ..... F01D 21/003; F01D 11/20; F01D 11/24

See application file for complete search history.

(56) References Cited

U.S. PATENT DOCUMENTS

| | | | | |
|---|---|---|---|---|
| 4,513,567 | A | 4/1985 | Deveau et al. | |
| 6,487,491 | B1 | 11/2002 | Karpman et al. | |
| 7,455,495 | B2 | 11/2008 | Leogrande et al. | |
| 7,491,029 | B2 | 2/2009 | Pezzetti, Jr. et al. | |
| 7,717,671 | B2 | 5/2010 | Addis | |
| 8,011,883 | B2 | 9/2011 | Schwarz et al. | |
| 8,186,945 | B2 * | 5/2012 | Bhatnagar | F01D 11/22 415/173.1 |
| 8,434,997 | B2 | 5/2013 | Pinero et al. | |
| 8,939,709 | B2 * | 1/2015 | Nanukuttan | F01D 11/22 277/355 |
| 9,097,133 | B2 * | 8/2015 | Dong | F01D 11/08 |
| 2003/0120415 | A1 * | 6/2003 | Seeley | F01D 17/085 701/100 |

(Continued)

OTHER PUBLICATIONS

EP Search Report dated Feb. 23, 2016.

*Primary Examiner* — Ninh H Nguyen
(74) *Attorney, Agent, or Firm* — O'Shea Getz, P.C.

(57) ABSTRACT

A method is provided for calibrating an active clearance control system for a plurality of turbine engines. During this method, a squeeze test is performed between a tip of a rotor blade and a shroud. Results of the squeeze test are applied to adjust a gap between the tip and the shroud. The performance of the squeeze test and the application of the results may be individually performed for each of the turbine engines.

20 Claims, 7 Drawing Sheets

(56) References Cited

U.S. PATENT DOCUMENTS

| | | | |
|---|---|---|---|
| 2006/0140756 | A1 | 6/2006 | Schwarz et al. |
| 2011/0243708 | A1 | 10/2011 | Hafner |
| 2013/0089408 | A1 | 4/2013 | Joe et al. |
| 2013/0195655 | A1 | 8/2013 | Kerner et al. |
| 2013/0336758 | A1 | 12/2013 | Harris |
| 2014/0321985 | A1 | 10/2014 | Lewis |

* cited by examiner

SMART ACTIVE CLEARANCE CONTROL BETWEEN A ROTOR BLADE AND A SHROUD

This application claims priority to U.S. Patent Appln. No. 62/036,452 filed Aug. 12, 2014.

BACKGROUND OF THE INVENTION

1. Technical Field

This disclosure relates generally to active clearance control between a rotor blade and a shroud.

2. Background Information

A turbine engine may include a fan section, a compressor section, a combustor section and a turbine section. Rotor blades in the compressor and the turbine sections may be surrounded by annular shrouds. To reduce leakage between tips of the rotor blades and the shrouds, the turbine engine may include an active clearance control (ACC) system.

A typical active clearance control system is configured to change a diameter of a base structure to which a shroud is attached and arranged within. By changing the diameter of the base structure, the active clearance control system may change the diameter of the shroud and thereby change clearance between the shroud and the rotor blade tips.

The active clearance control system may be controlled using a universal control logic. This universal control logic may be derived from tests performed on a test turbine engine, and then applied to the active clearance control systems of all turbine engines of a particular model. Utilizing such a universal control logic, however, cannot account for variations between the turbine engines. For example, slight variations in the components of the active clearance control system and/or of the turbine engines may lead to slightly different engine characteristics. As a result, while the universal control logic may be particularly well suited for one turbine engine (particularly the test turbine engine), the universal control logic may operate another turbine engine with too much clearance and still another turbine engine with too little clearance. Too much and too little clearance may both reduce turbine engine efficiency. Too little clearance may also lead to rubbing and result in premature wear of the shrouds and/or the rotor blades.

There is a need in the art for improved systems and methods for controlling clearance between a rotor blade tip and a shroud.

SUMMARY OF THE DISCLOSURE

According to an aspect of the invention, a method is provided method for calibrating an active clearance control system for a plurality of turbine engines. The method includes: performing a squeeze test between a tip of a rotor blade and a shroud; and applying results of the squeeze test to adjust a gap between the tip and the shroud. The performing of the squeeze test and the applying of the results is individually performed for each of the turbine engines.

According to another aspect of the invention, a turbine engine is provided that includes a rotor blade extending to a tip and a shroud radially outboard of the tip. The turbine engine also includes an active clearance control system configured to: perform a squeeze test between the tip and the shroud; and control clearance between the tip and the shroud based on results of the squeeze test. The active clearance control system may also be operable for recalibration based on performance of another squeeze test.

According to still another aspect of the invention, another turbine engine is provided that includes a rotor blade extending to a tip and a shroud radially outboard of the tip. This production turbine engine also includes a system configured to actively control clearance between the tip and the shroud based on a control logic. The system is further configured to recalibrate the control logic.

The turbine engine may be a production turbine engine.

The applying of the results may include, for at least a first of the turbine engines, calibrating and/or recalibrating a control logic for the active clearance control system based on the results of the squeeze test.

The squeeze test may be performed, for at least a first of the turbine engines, while the first of the turbine engines is configured with a test stand.

The squeeze test may be performed, for at least a first of the turbine engines, while the first of the turbine engines is operating during aircraft flight.

The tip and the shroud may radially engage one another during the squeeze test.

The applying of the results (e.g., calibration or recalibration) may account for wear of the shroud during the squeeze test.

The squeeze test may be performed, for at least a first of the turbine engines, at or after a predetermined interval of operation of the first of the turbine engines.

The results may be applied, for at least a first of the turbine engines, to adjust the gap across a flight envelope of the first of the turbine engines.

The active clearance control system may be configured to perform an additional squeeze test between the tip and the shroud during inflight operation of the turbine engine. The system may also be configured to recalibrate a control logic of the active clearance control system based on results of the additional squeeze test.

The turbine engine may include an apparatus (e.g., base structure or case) to which the shroud is attached or formed integral with. The active clearance control system may be configured to actively control clearance between the tip and the shroud by regulating temperature of the apparatus. The active clearance control system may also or alternatively be configured to actively control clearance between the tip and the shroud by mechanically reconfiguring the apparatus.

The system may be configured to perform a squeeze test between the tip and the shroud. The recalibration of the control logic may be performed based on the results of the squeeze test.

The system may be configured to recalibrate the control logic after one or more predetermined intervals of operation of the production turbine engine.

The foregoing features and the operation of the invention will become more apparent in light of the following description and the accompanying drawings.

DETAILED DESCRIPTION OF THE INVENTION

Figure 1:
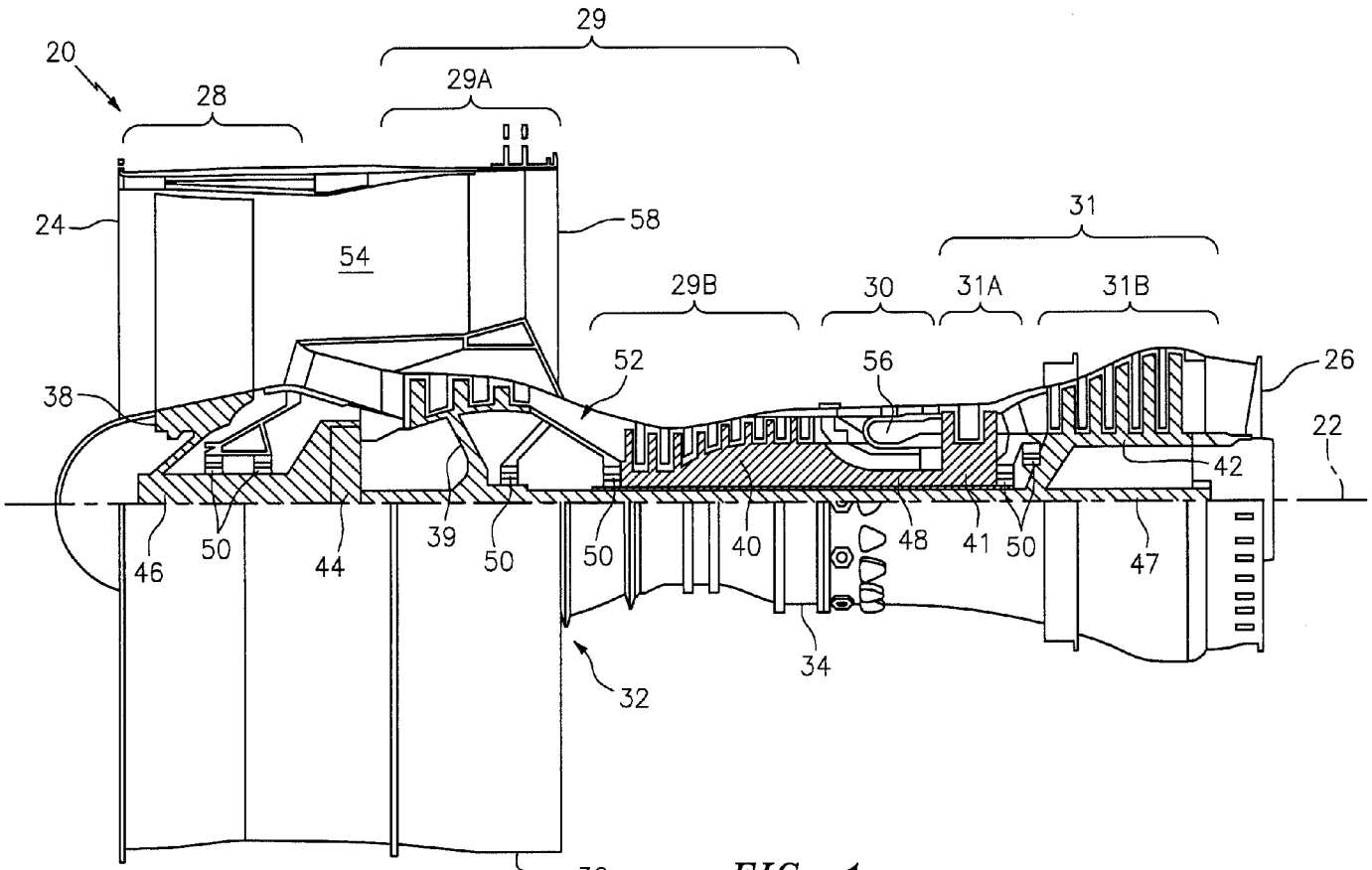
FIG. 1 is a side cutaway illustration of a geared turbine engine, according to an embodiment.

FIG. 1 is a side cutaway illustration of a geared turbine engine 20, which may be a production turbine engine. The term "production" may describe a turbine engine being manufactured according to a model specification, which turbine engine is to be delivered ultimately for personal, commercial or government use; e.g., to power a personal, commercial or government aircraft. An aircraft production turbine engine, for example, may be certified by one or more government and/or non-government organizations (e.g., U.S. Federal Aviation Administration or FAA) for non-test use. Such a turbine engine typically is one of a plurality of turbine engines that are manufactured according to the model specification. Production turbine engines, of course, may have slight variations therebetween as a result of one or more revisions to the model specification, changes in part supplier(s), revised manufacturing techniques, tolerances, etc. Production turbine engines may also be intermittently tested before and/or during use. By contrast, a test turbine engine is a turbine engine which is used strictly for engine testing purposes. For example, a test turbine engine may be built for conducting engine tests on a test stand or on a test aircraft in order to obtain necessary data for government certifications of a production turbine engine.

Referring again to FIG. 1, the turbine engine 20 extends along an axial centerline 22 between an upstream airflow inlet 24 and a downstream airflow exhaust 26. The turbine engine 20 includes a fan section 28, a compressor section 29, a combustor section 30 and a turbine section 31. The compressor section 29 includes a low pressure compressor (LPC) section 29A and a high pressure compressor (HPC) section 29B. The turbine section 31 includes a high pressure turbine (HPT) section 31A and a low pressure turbine (LPT) section 31B.

The engine sections 28-31 are arranged sequentially along the centerline 22 within an engine housing 32. This housing 32 includes an inner case 34 (e.g., a core case) and an outer case 36 (e.g., a fan case). The inner case 34 houses the engine sections 29-31; e.g., an engine core. The outer case 36 houses the fan section 28 and axially overlaps a forward portion of the inner case 34.

Each of the engine sections 28, 29A, 29B, 31A and 31B includes a respective rotor 38-42. Each of these rotors 38-42 includes a plurality of rotor blades arranged circumferentially around and connected to one or more respective rotor disks. The rotor blades, for example, may be formed integral with or mechanically fastened, welded, brazed, adhered and/or otherwise attached to the respective rotor disk(s).

The fan rotor 38 is connected to a gear train 44, for example, through a fan shaft 46. The gear train 44 and the LPC rotor 39 are connected to and driven by the LPT rotor 42 through a low speed shaft 47. The HPC rotor 40 is connected to and driven by the HPT rotor 41 through a high speed shaft 48. The shafts 46-48 are rotatably supported by a plurality of bearings 50; e.g., rolling element and/or thrust bearings. Each of these bearings 50 is connected to the engine housing 32 by at least one stationary structure such as, for example, an annular support strut.

During operation, air enters the turbine engine 20 through the airflow inlet 24, and is directed through the fan section 28 and into a core gas path 52 and a bypass gas path 54. The air within the core gas path 52 may be referred to as "core air". The air within the bypass gas path 54 may be referred to as "bypass air". The core air is directed through the engine sections 29-31, and exits the turbine engine 20 through the airflow exhaust 26 to provide forward engine thrust. Within the combustor section 30, fuel is injected into a combustion chamber 56 and mixed with the core air. This fuel-core air mixture is ignited to power the turbine engine 20. The bypass air is directed through the bypass gas path 54 and out of the turbine engine 20 through a bypass nozzle 58 to provide additional forward engine thrust. Alternatively, at least some of the bypass air may be directed out of the turbine engine 20 through a thrust reverser to provide reverse engine thrust.

Figure 2:
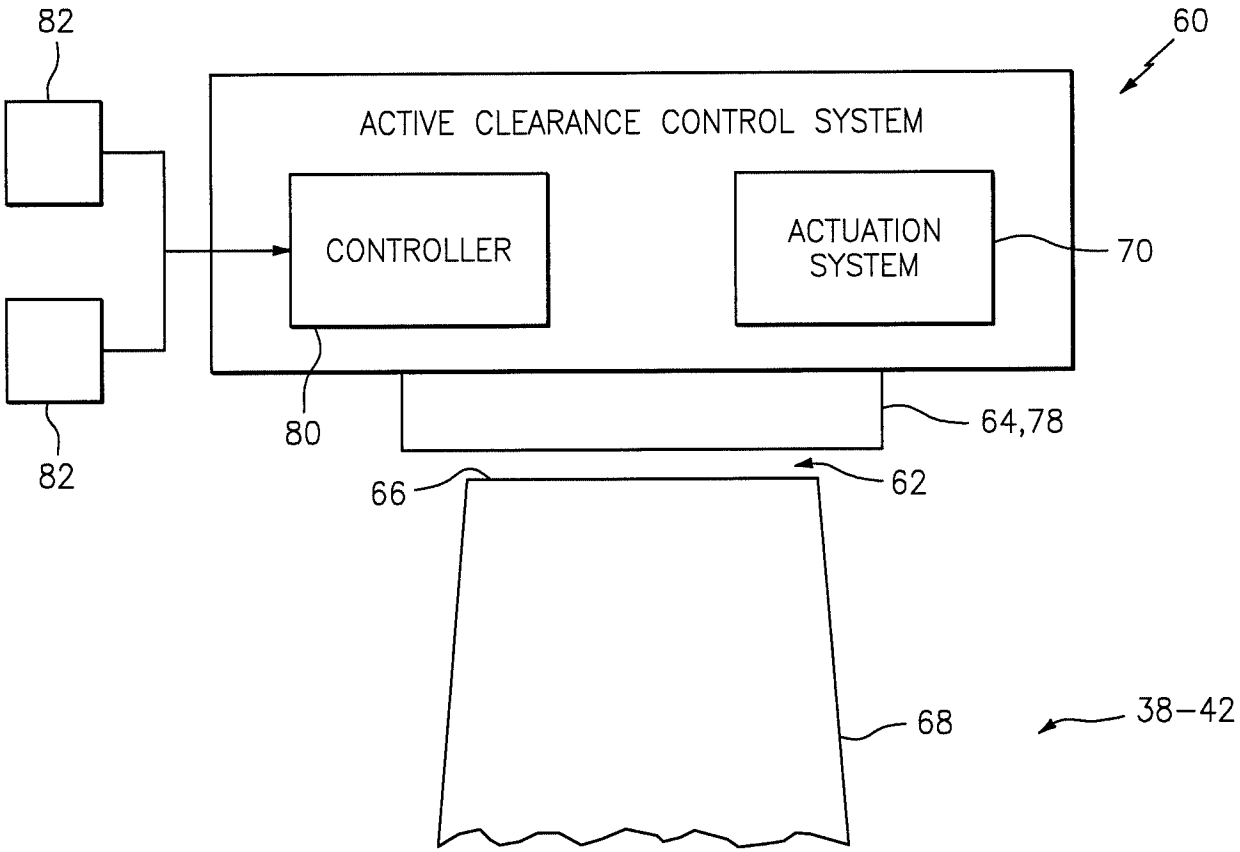
FIG. 2 is a block diagram of an active clearance control system for controlling clearance between a rotor blade tip and a shroud, according to an embodiment.

FIG. 2 illustrates a smart active clearance control (SMACC) system 60 for the turbine engine 20. This SMACC system 60 is configured to actively control tip clearance 62 for at least one of the rotors 38-42. More particularly, the SMACC system 60 is configured to control a size (e.g., radial height) of a (e.g., radial) gap between at least one annular shroud 64 and a tip 66 of one or each rotor blade 68 (e.g., a fan, compressor or turbine blade) in at least one stage of the respective rotor 38-42. An example of a shroud is a segmented or non-segmented abradable blade outer air seal (BOAS), which is disposed radially outboard of and (e.g., axially) aligned with the rotor blades. By actively controlling the tip clearance 62 (e.g., the height of the radial gap), the SMACC system 60 may reduce leakage between the rotor blades 68 and the shroud 64 and thereby increase turbine engine 20 efficiency.

The SMACC system 60 is also configured to perform one or more squeeze tests between the rotor blade tips 66 and the shroud 64. The term "squeeze test" may describe a test conducted to determine at which point a rotor blade tip (or tips) radially engage and contact (or almost contact) a shroud. By processing results of the squeeze test(s), the SMACC system 60 may adapt (e.g., calibrate and/or recalibrate) its control logic such that optimal tip clearance 62 may be maintained for one or more operating conditions. It is also worth noting, since the SMACC system 60 may adapt its control logic based on the squeeze test(s) performed on that specific turbine engine 20, the adapted control logic may more accurately model tip clearance 62 behavior for that engine 20. By contrast, where a control logic such as a universal control logic is calibrated based on results of a squeeze test performed on a first engine (e.g., test engine), this universal control logic may not accurately model tip clearance behavior of another engine (e.g., a production engine) to which the control logic is applied due to variations between the engines.

Figure 3:
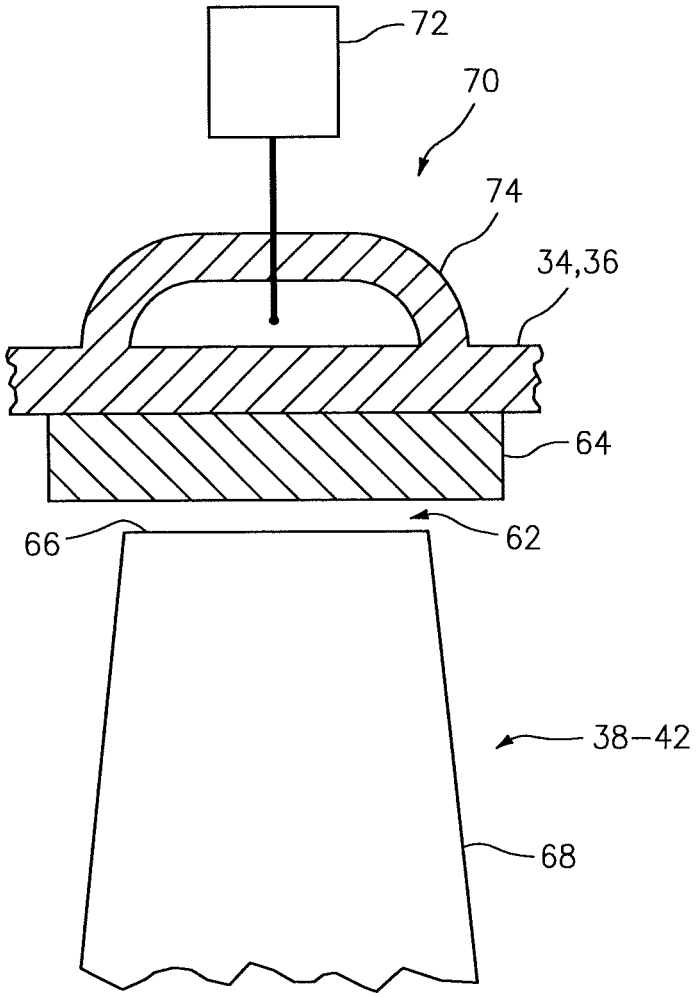
FIG. 3 is a block diagram of an actuator system for changing clearance between a rotor blade tip and a shroud, according to an embodiment.

The SMACC system 60 may include an actuation system 70 for controlling tip clearance 62 as well as performing the squeeze test(s). Referring to FIG. 3, the actuation system 70 may include at least one flow regulator 72 (e.g., a valve, a pump, etc.) and at least one duct 74 fluidly coupled with the flow regulator 72. The flow regulator 72 is adapted to regulate flow of fluid, such as air bled or otherwise diverted from the core gas path 52 and/or bypass gas path 54 (see FIG. 1), through the duct 74, or some other fluid, including, for example, hydraulic fluid, oil, or fuel. The duct 74 is configured to direct the regulated flow of fluid for interaction (e.g., heat exchange) with an apparatus (e.g., the case 34, 36 or another structure) to which the shroud 64 may be attached (mechanically fastened, bonded and/or adhered) or formed integral with. At least a portion of the duct 74, for example, may at least partially circumscribe and/or be configured with the case 34. In this manner, the duct 74 may deliver cooling air to the case 34, which cooling air may actively control thermal expansion/contraction of the case 34 by selectively cooling or heating the case 34. By controlling thermal expansion/contraction of the case 34, the actuation system 70 may control the diameter of the case 34 and, thus, the clearance between the shroud 64 and the rotor blade tips 66. Another example of such a system for controlling clearance by regulating temperature of an apparatus to which a shroud is connected is disclosed in U.S. Pat. No. 8,434,997, which is hereby incorporated herein by reference in its entirety.

Figure 4:
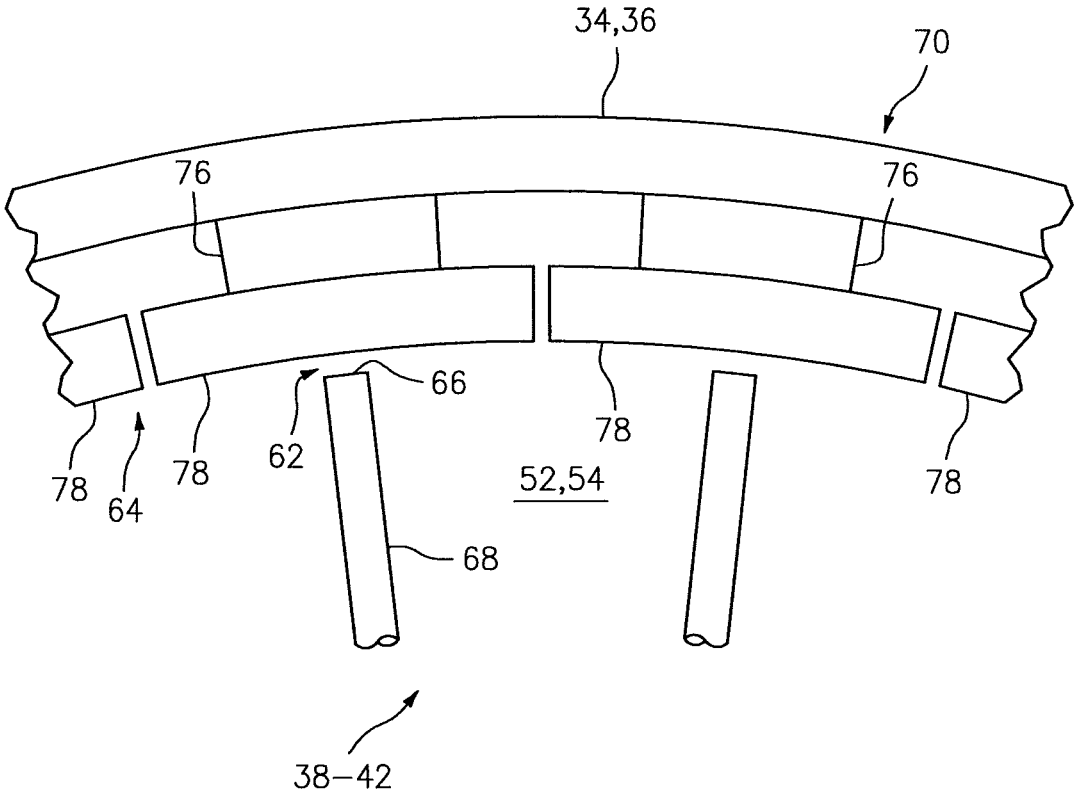
FIG. 4 is a block diagram of another actuator system for changing clearance between a rotor blade tip and a shroud, according to an embodiment.

Referring now to FIG. 4, the actuation system 70 may also or alternatively include one or more actuators 76. The actuators 76 are configured to (e.g., radially) displace one or more circumferential segments 78 of the shroud 64. In this manner, the actuators 76 may control the diameter of the shroud 64 and, thus, the clearance 62 between the shroud 64 and the rotor blade tips 66. Another example of such a system for controlling clearance by mechanically reconfiguring an apparatus to which a shroud is connected disclosed in U.S. patent application Ser. No. 13/495,454, which is hereby incorporated herein by reference in its entirety. It is worth noting, however, the SMACC system 60 of the present disclosure is not limited to the foregoing exemplary actuation system types and configurations.

Referring again to FIG. 2, the SMACC system 60 also includes a controller 80 for controlling operation of the actuation system 70. This controller 80 may be separate from or integrated with one or more other turbine engine controllers and/or aircraft controllers. The controller 80 is in signal communication (e.g., hardwired and/or wirelessly coupled) with the actuation system 70. The controller 80 may also be in signal communication with one or more other engine sensors 82 and/or other turbine engine components.

The controller 80 may be implemented with a combination of hardware and software. The hardware may include memory and at least one processing device, which may include one or more single-core and/or multi-core processors. The hardware may also or alternatively include analog and/or digital circuitry other than that described above.

The memory is configured to store software (e.g., program instructions and control logics) for execution by the processing device, which software execution may control and/or facilitate performance of one or more operations such as those described in the methods below. The memory may be a non-transitory computer readable medium. For example, the memory may be configured as or include a volatile memory and/or a nonvolatile memory. Examples of a volatile memory may include a random access memory (RAM) such as a dynamic random access memory (DRAM), a static random access memory (SRAM), a synchronous dynamic random access memory (SDRAM), a video random access memory (VRAM), etc. Examples of a nonvolatile memory may include a read only memory (ROM), an electrically erasable programmable read-only memory (EEPROM), a computer hard drive, etc.

Figure 5:
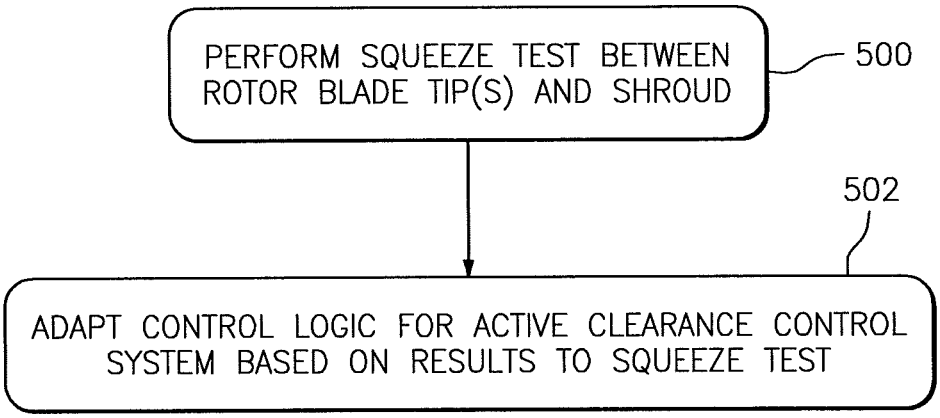
FIG. 5 is a flow diagram of a method involving an active clearance control system for controlling clearance between a rotor blade tip and a shroud, according to an embodiment.

FIG. 5 is a flow diagram of a method involving a turbine engine such as the turbine engine 20 and, more particularly, a method for configuring and controlling an active clearance control system such as the SMACC system 60. In block 500, the SMACC system 60 performs a squeeze test between the rotor blade tips 66 and the shroud 64. This test may be performed while the turbine engine 20 is configured with a test stand. Alternatively, the squeeze test may be performed while the turbine engine 20 is operating during, for example, aircraft flight and/or normal operation.

During the squeeze test, the controller 80 signals the actuation system 70 to reduce the tip clearance 62 to or below zero such that the rotor blade tips 66 and the shroud 64 engage (or almost engage) one another; e.g., the shroud 64 is "squeezed" onto the rotor blade tips 66. The controller 80 may determine the rotor blade tips 66 and the shroud 64 are engaging where, for example, there is a decrease in performance of the turbine engine 20. Alternatively, a change in turbine engine performance may be measured right before the rotor blade tip(s) 66 engage the shroud 64 and processed to predict when the rotor blade tip(s) 66 will engage the shroud 64. Exemplary measures of turbine engine 20 performance include, but are not limited to, thrust output, gas temperature at one or more locations, gas pressure at one or more locations, turbine engine emissions, rotor and/or shaft speed, etc. The turbine engine 20 performance may be measured using one or more of the engine sensors 82. The SMACC system 60 may also or alternatively include or receive signals from one or more other sensors (e.g., camera(s), laser(s), vibration sensor(s), capacitance probe(s), microwave sensor(s), etc.) that measure other engine parameters and/or directly measure tip clearance 62 through non-contact sensing. The foregoing process may also be repeated at different engine operating states (e.g., half power, three-quarters power, full power, etc.) in order to more completely map changes in tip clearance 62.

In block 502, the SMACC system 60 adapts its control logic based on the results from the squeeze test. The controller 80, for example, may process results from the squeeze test of the step 500 in order to calibrate or recalibrate the control logic; e.g., set or adjust a target tip clearance for one or more points across the power band. In this manner, the SMACC system 60 may apply the results from the squeeze test to (e.g., optimally) adjust a gap between the rotor blade tips 66 and the shroud 64.

The term "calibrate" may describe a process of setting one or more points, variables and/or terms in the control logic for a first time using data from a first squeeze test. For example, the controller 80 may calibrate the control logic based off of results from a squeeze test which is performed for the first time during pre-flight and/or pre-delivery test operation. Note, the control logic calibration may actually recalibrate initial settings for the control logic where the initial settings were not derived from a squeeze test performed on that specific engine but rather, for example, another test or certification engine.

The term "recalibrate" may describe a process of setting one or more points, variables and/or terms in the control logic for a second, third, fourth, etc. time using data from a respective second, third, fourth, etc. squeeze test. For example, the controller 80 may recalibrate the control logic based off of results from a squeeze test that is repeated at or after an interval of operation; e.g., a predetermined interval of operating time or flights; before, after and/or during scheduled maintenance; etc. Such recalibration may be performed to account for operational wear of the shroud 64, the rotor blades 68, etc. and thereby re-optimize tip clearance 62. Such recalibration may be performed one or more times during the life of the turbine engine 20. Furthermore, the method of FIG. 5 may be repeated more frequently while the turbine engine 20 is relatively new and less frequently as the turbine engine 20 gets older since more wear generally occurs for newer engines than older engines.

In some embodiments, the adaptation step 502 may be performed to account for shroud 64 and/or rotor blade 68 wear that results from performance of the squeeze test itself. The target tip clearance, for example, may be adjusted to account for possible wear during the test. For example, the controller 80 may signal the flow regulator 72 (e.g., valve) to "leak". This leaking may allow additional fluid to pass through the flow regulator 72 to further cool the case 34, thereby closing clearances between the shroud 64 and rotor blades 68 to account for wear.

Figure 6:
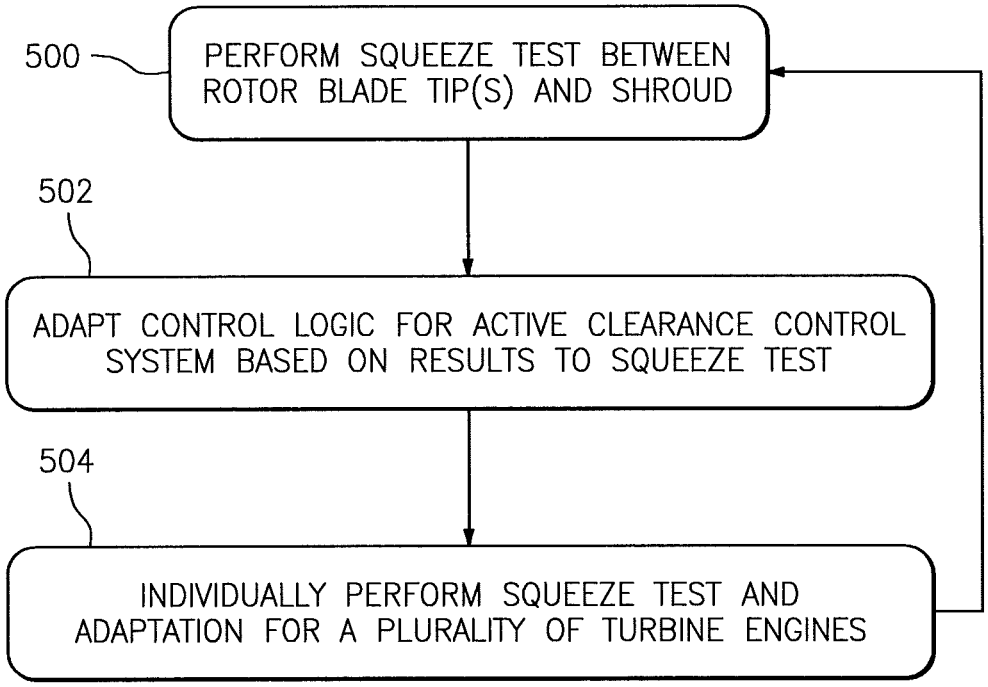
FIG. 6 is a flow diagram of another method involving an active clearance control system for controlling clearance between a rotor blade tip and a shroud, according to an embodiment.

In some embodiments, referring to FIG. 6, the squeeze test step 500 and the adaptation step 502 may also be individually performed for one or more other turbine engines (see block 604). For example, a plurality of production turbine engines may each have its respective control logic calibrated before delivery. The SMACC system 60 for each of these production turbine engines may subsequently recalibrate its control logic as desired and/or as necessary. Alternatively, the control logic for each of the turbine engines may be initially set as a universal control logic and subsequently recalibrated using the method of FIG. 5, for example.

Figure 7:
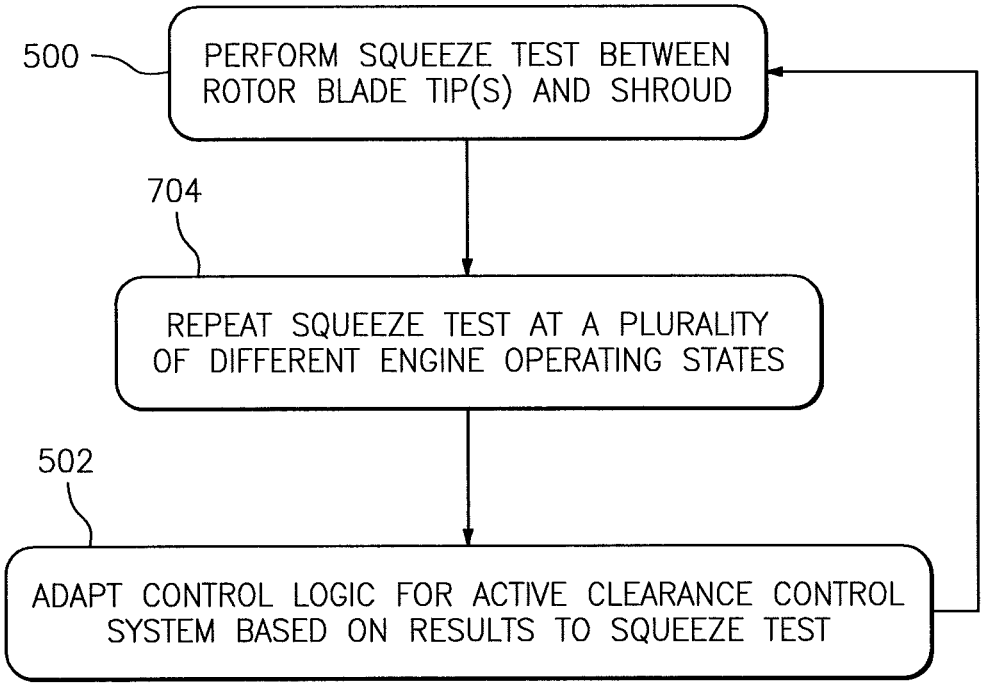
FIG. 7 is a flow diagram of still another method involving an active clearance control system for controlling clearance between a rotor blade tip and a shroud, according to an embodiment.

In some embodiments, referring to FIG. 7, the squeeze test step 500 may be repeated (see block 704) one or more times while the turbine engine 20 is operating at difference operating states; e.g., idle, part throttle, full throttle, etc. The results from each of the squeeze test steps 500 may subsequently be processed with one another to adapt the control logic across a portion or substantially the entire flight envelope of the turbine engine 20.

The terms "upstream", "downstream", "inner" and "outer" are used to orientate the components of the turbine engine 20 and the SMACC system 60 described above relative to the turbine engine 20 and its axial centerline 22. A person of skill in the art will recognize, however, one or more of these components may be utilized in other orientations than those described above. The present invention therefore is not limited to any particular spatial orientations.

The SMACC system 60 may be included in various turbine engines other than the one described above including industrial turbine engines. The SMACC system 60, for example, may be included in a geared turbine engine where a gear train connects one or more shafts to one or more rotors in a fan section, a compressor section and/or any other engine section. Alternatively, the SMACC system 60 may be included in a turbine engine configured without a gear train. The SMACC system 60 may be included in a geared or non-geared turbine engine configured with a single spool, with two spools (e.g., see FIG. 1), or with more than two spools. The turbine engine may be configured as a turbofan engine, a turbojet engine, a propane engine, or any other type of turbine engine. The present invention therefore is not limited to any particular types or configurations of turbine engines.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. A method for calibrating an active clearance control system for a plurality of turbine engines, the method comprising:

performing a squeeze test between a tip of a rotor blade and a shroud; and applying results of the squeeze test to adjust a gap between the tip and the shroud;

wherein the performing of the squeeze test and the applying of the results is individually performed for each of the turbine engines.

2. The method of claim 1, wherein the applying of the results comprises, for at least a first of the turbine engines, calibrating a control logic for the active clearance control system based on the results of the squeeze test.

3. The method of claim 1, wherein the applying of the results comprises, for at least a first of the turbine engines, recalibrating a control logic for the active clearance control system based on the results of the squeeze test.

4. The method of claim 1, wherein the squeeze test is performed, for at least a first of the turbine engines, while the first of the turbine engines is configured with a test stand.

5. The method of claim 1, wherein the squeeze test is performed, for at least a first of the turbine engines, while the first of the turbine engines is operating during aircraft flight.

6. The method of claim 1, wherein the tip and the shroud radially engage one another during the squeeze test.

7. The method of claim 1, wherein the applying of the results accounts for wear of the shroud during the squeeze test.

8. The method of claim 1, wherein the squeeze test is performed, for at least a first of the turbine engines, after a predetermined interval of operation of the first of the turbine engines.

9. The method of claim 1, wherein the results are applied, for at least a first of the turbine engines, to adjust the gap across a flight envelope of the first of the turbine engines.

10. The method of claim 1, wherein at least a first of the turbine engines comprises a production turbine engine.

11. A turbine engine, comprising:

a rotor blade extending to a tip;

a shroud radially outboard of the tip; and an active clearance control system configured to perform a squeeze test between the tip and the shroud; and control clearance between the tip and the shroud based on results of the squeeze test;

wherein the active clearance control system is operable for recalibration based on performance of another squeeze test.

12. The turbine engine of claim 11, wherein the active clearance control system is further configured to perform an additional squeeze test between the tip and the shroud during inflight operation of the turbine engine; and recalibrate a control logic of the active clearance control system based on results of the additional squeeze test.

13. The turbine engine of claim 11, further comprising:

an apparatus to which the shroud is attached or formed integral with;

wherein the active clearance control system is configured to actively control clearance between the tip and the shroud by regulating temperature of the apparatus.

14. The turbine engine of claim 11, further comprising:

an apparatus to which the shroud is attached or formed integral with;

wherein the active clearance control system is configured to actively control clearance between the tip and the shroud by mechanically reconfiguring the apparatus.

15. The turbine engine of claim 11, wherein the controlling of the clearance based on the results of the squeeze test accounts for wear of the shroud during the squeeze test.

16. A turbine engine, comprising:

a rotor blade extending to a tip;

a shroud radially outboard of the tip; and a system configured to actively control clearance between the tip and the shroud based on a control logic, the system further configured to recalibrate the control logic.

17. The turbine engine of claim 16, wherein the system is configured to perform a squeeze test between the tip and the shroud; and the recalibration of the control logic is performed based on the results of the squeeze test.

18. The turbine engine of claim 16, wherein the system is configured to recalibrate the control logic after one or more predetermined intervals of operation of the production turbine engine.

19. The turbine engine of claim 16, further comprising:

an apparatus to which the shroud is attached or formed integral with;

wherein the system is configured to actively control clearance between the tip and the shroud by regulating temperature of the apparatus.

20. The turbine engine of claim 16, further comprising:

an apparatus to which the shroud is attached or formed integral with;

wherein the system is configured to actively control clearance between the tip and the shroud by mechanically reconfiguring the apparatus.

* * * * *